US010694840B2

(12) United States Patent
Torno

(10) Patent No.: US 10,694,840 B2
(45) Date of Patent: Jun. 30, 2020

(54) MAKEUP BRUSH KIT

(71) Applicant: Rose Torno, North York (CA)

(72) Inventor: Rose Torno, North York (CA)

( * ) Notice: Subject to any disclaimer, the term of this patent is extended or adjusted under 35 U.S.C. 154(b) by 277 days.

(21) Appl. No.: 15/952,397

(22) Filed: Apr. 13, 2018

(65) Prior Publication Data

US 2019/0008272 A1 Jan. 10, 2019

Related U.S. Application Data

(60) Provisional application No. 62/530,628, filed on Jul. 10, 2017.

(51) Int. Cl.

| | |
|---|---|
| ***A45D 40/24*** | (2006.01) |
| ***A46B 17/04*** | (2006.01) |
| ***A46B 5/02*** | (2006.01) |
| ***A45D 44/00*** | (2006.01) |
| ***A46B 5/00*** | (2006.01) |
| ***A46B 15/00*** | (2006.01) |
| ***A45C 11/24*** | (2006.01) |
| ***A46B 9/02*** | (2006.01) |
| ***A45C 11/00*** | (2006.01) |

(52) U.S. Cl.

CPC ..... *A46B 17/04* (2013.01); *A45C 11/008* (2013.01); *A45C 11/24* (2013.01); *A45D 44/00* (2013.01); *A46B 5/0016* (2013.01); *A46B 5/02* (2013.01); *A46B 9/021* (2013.01); *A46B 15/0093* (2013.01); *A45D 2200/25* (2013.01)

(58) Field of Classification Search

CPC .... A45D 40/24; A45D 40/262; A45D 40/265; A45D 2200/25; A45D 2200/1072; A45D 33/00; A45D 33/006; A45D 34/042; A45D 34/06; A45D 2040/0012; A46B 2200/106; A46B 2200/1046; A46B 2200/1053; A46B 17/04; A46B 5/02; A46B 5/0016; A46B 9/021; A46B 15/0093; A45C 11/008; A45C 11/24

USPC ..... 206/350, 229, 581; 401/131

See application file for complete search history.

(56) References Cited

U.S. PATENT DOCUMENTS 5,025,817 A * 6/1991 Wen ..... A45D 33/006 132/294
5,398,706 A * 3/1995 Epstein ..... A45D 33/006 132/273
D364,248 S * 11/1995 Su ..... D28/86
5,921,394 A * 7/1999 Shroff ..... B65D 83/0454 206/533

(Continued)

*Primary Examiner* — Rachel R Steitz
*Assistant Examiner* — Karim Asqiriba
(74) *Attorney, Agent, or Firm* — IPS Legal Group, P.A.

(57) ABSTRACT

A makeup brush set comprises a cylinder compact having a transparent rotating element disposed on its exterior. Inside, five double ended brushes are provided and stored in their own separated space, held in place by at least one magnetic connection between the brush and the cylinder. A button is provided on the cylinder that may cause the transparent rotating element to rotate, thereby exposing at least one brush for removal. In some embodiments, a small double ended storage compartment for mini eyeliners, lipliners, tweezers or small jewelry may be disposed on the exterior of this brush set. Both ends of the cylinder case may contain the last two larger brushes which may each be covered by an end cap.

15 Claims, 4 Drawing Sheets

(56) References Cited

U.S. PATENT DOCUMENTS

| | | | | |
|---|---|---|---|---|
| 7,156,226 | B1 * | 1/2007 | Van Sickle | A45C 11/20 206/1.5 |
| D701,000 | S * | 3/2014 | DiGirolamo | D28/73 |
| 9,380,860 | B1 * | 7/2016 | Taylor | A46B 17/06 |
| D789,611 | S * | 6/2017 | Filho | D28/73 |
| 9,848,723 | B1 * | 12/2017 | Huang | A46B 17/08 |
| 2006/0000728 | A1 * | 1/2006 | Lee | A45C 11/008 206/361 |
| 2007/0199575 | A1 * | 8/2007 | Del Ponte | A45D 40/18 132/320 |
| 2011/0174680 | A1 * | 7/2011 | Arvin | A45D 33/00 206/581 |
| 2014/0325779 | A1 * | 11/2014 | Dansby | A46B 17/02 15/168 |

* cited by examiner

MAKEUP BRUSH KIT

CROSS-REFERENCE TO RELATED APPLICATION

This application claims priority to U.S. Provisional Application No. 62/530,628 filed on Jul. 10, 2017, the disclosure of which, including any materials incorporated by reference therein, is incorporated herein by reference in its entirety.

TECHNICAL FIELD

The present invention relates generally to makeup accessories. More particularly, the present invention concerns a compact makeup brush kit.

BACKGROUND

When it comes to makeup, the right brush can make a significant difference. This is true not only for professional makeup artists, but for every person applying makeup. In fact, many professionals and experienced makeup users believe that there are twelve main brushes that, together, accomplish excellent full makeup application. It is therefore very important to not only identify which twelve brush styles fit these specifics, but to also identify the right brands or models of these twelve brushes.

Additionally, the right size makeup brush container is important as well. When a person does not use a dedicated brush container, she or he can experience frustration when they cannot easily find the right brush in their makeup bag. Or, when such a person does use a brush containing-bag, many times the brush-containing bag is too big to fit into a small purse (a "clutch"). In such a circumstance, the person cannot bring her or his favorite brush to an event that requires a clutch, such as a party. What is needed therefore, is a compact twelve-brush makeup kit.

Attempts have been made, although unsuccessfully, to solve this problem. One illustrative attempt can be seen with respect to U.S. Patent No. 2004/016870, which generally discloses a makeup brush set having interchangeable handle/brush combinations. Although this disclosure does provide for a portable brush set, it fails to provide for the right twelve brushes and also fails to provide for a properly configured carrying case.

Another attempt to meet this need can be seen with respect to U.S. Pat. No. 7,021,318, which generally discloses a box-shaped makeup kit. While this disclosure does provide for a portable makeup, it fails to provide for the right twelve brushes and also fails to provide for a carrying case that could fit in a clutch.

Another attempt can be seen with respect to U.S. Patent Application Publication No. 2014/0341631, which generally discloses a cylindrical makeup case. Although this disclosure does provide for a cylindrical makeup case that could conceivably fit into a clutch, it fails to provide for the right twelve brushes.

As can be seen, various attempts have been made to solve the problems which may be found in the related art but have been unsuccessful. A need exists for a new compact twelve-brush makeup kit to avoid the challenges and problems with the prior art.

SUMMARY OF THE INVENTION

It is to be understood that in the present disclosure, all embodiments are provided as illustrative and non-limiting representatives of many possible embodiments. In addition, the terms "is," "can," "will," and the like are herein used as synonyms for and interchangeable with terms such as "may," "may provide for," and "it is contemplated that the present invention may" and so forth.

Furthermore, all elements listed by name, such as a brush, powder, etc., are herein meant to include or encompass all equivalents for such elements. For example, in addition to a "brush", any application element is also contemplated by the present invention. Such equivalents are contemplated for each element named in its particular herein.

For purposes of summarizing, certain aspects, advantages, and novel features of the present invention are provided herein. It is to be understood that not all such aspects, advantages, or novel features may be provided in any one particular embodiment. Thus, the disclosed subject matter may be embodied or carried out in a manner that achieves or optimizes one aspect, advantage, or novel feature or group of features without achieving all aspects, advantages, or novel features as may be taught or suggested.

In view of the foregoing disadvantages inherent in the known art, the present invention relates to a makeup brush kit that overcomes the deficiencies of the prior art. The general purpose of the present invention, which shall be described subsequently in greater detail, is to allow a user to utilize a number of different brushes quickly and easily.

The features of the invention which are believed to be novel are particularly pointed out and distinctly claimed in the concluding portion of the specification. By way of non-limiting example, the present invention provides a novel solution for applying makeup. These and other features, aspects, and advantages of the present invention will become better understood with reference to the following drawings and detailed description.

In one embodiment, the present invention comprises a compact twelve-brush makeup kit. In some embodiments, the present invention provides for a compact rotational brush set that has all the twelve (12) basic brushes a user may need for a full make-up application. The present invention's brush set is compact enough to fit in a clutch and is configured such that the brushes may be put away in an organized manner in its container where it won't be hard to find in a user's make-up bag.

More specifically, the present invention may provide for a cylinder compact with a transparent rotating exterior. Inside, five double ended brushes are stored in their own separated space. The interior of the brush set where the brushes are stored is magnetic so that the brushes are securely placed. For access to the double ended brushes, a user may press on the main opening to rotate and pull out whichever brush a user might need. Due to the exterior being transparent, a user may be able to see which brush the user would like to select. When a user twists the dial to access the makeup brushes, there is an opening for access with the exact size of the individual space of each double ended brush. Within the exterior of this brush set is a small double ended storage made for mini eyeliners/lipliners/tweezers or even small jewelry. Both ends of the cylinder case contain the last two larger brushes which will be covered with two of their own caps. A user may unscrew the larger brushes for access to the mini storage compartment for this brush set design.

Therefore, in some embodiments, five double ended and magnetic brushes may be provided that magnetically attach to a cylindrical makeup case configured to be compact and yet accessible. In some embodiments, the present invention may further comprise a carrying case. The carrying case may resemble a bag having a zipper, a snap clasp, or any other carrying case known in the art.

The unique features of this product will provide the following benefits for consumers everywhere:

Easy organization of brushes.

Easy to use.

Enables anyone to identify the twelve main brushes for makeup application.

The embodiments of the invention described herein are exemplary and numerous modifications, variations and rearrangements can be readily envisioned to achieve substantially equivalent results, all of which are intended to be embraced within the spirit and scope of the invention. Furthermore, while the preferred embodiment of the invention has been described in terms of the components and configurations, it is understood to that the invention is not intended to be limited to those specific dimensions or configurations but is to be accorded the full breadth and scope of the spirit of the invention.

BRIEF DESCRIPTION OF THE DRAWINGS

These and other features, aspects and advantages of the present invention will become better understood with regard to the following description, appended claims, and accompanying figures where:

DETAILED DESCRIPTION

The present invention overcomes the limitations of the prior art by providing a new and more effective makeup brush kit.

All dimensions specified in this disclosure are by way of example only and are not intended to be limiting. Further, the proportions shown in these Figures are not necessarily to scale. As will be understood by those with skill in the art with reference to this disclosure, the actual dimensions and proportions of any embodiment or element of an embodiment disclosed in this disclosure will be determined by its intended use.

It is to be understood that the drawings and the associated descriptions are provided to illustrate potential embodiments of the invention and not to limit the scope of the invention. Reference in the specification to "one embodiment" or "an embodiment" is intended to indicate that a particular feature, structure, or characteristic described in connection with the embodiment is included in at least an embodiment of the invention. The appearances of the phrase "in one embodiment" or "an embodiment" in various places in the specification are not necessarily all referring to the same embodiment.

Throughout the drawings, reference numbers are re-used to indicate correspondence between referenced elements. In addition, the first digit of each reference number indicates the figure where the element first appears.

As used in this disclosure, except where the context requires otherwise, the term "comprise" and variations of the term, such as "comprising", "comprises" and "comprised" are not intended to exclude other additives, components, integers or steps.

In the following description, specific details are given to provide a thorough understanding of the embodiments. However, it will be understood by one of ordinary skill in the art that the embodiments may be practiced without these specific details. Well known features, elements or techniques may not be shown in detail in order not to obscure the embodiments.

Figure 1:
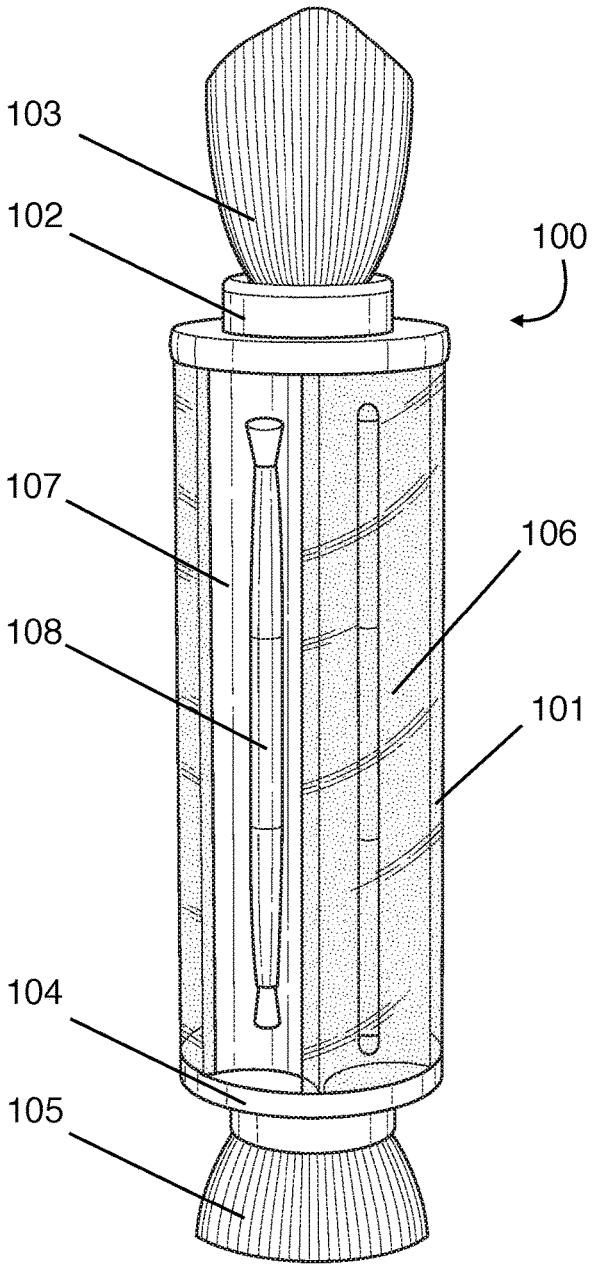
FIG. 1 shows a front perspective view of a makeup brush kit in accordance with an embodiment of the invention.

Turning attention to FIG. 1, a front perspective view of a makeup brush kit in accordance with an embodiment of the invention is shown. In the embodiment depicted, a viewer may perceive makeup brush kit 100, central cylinder 101, first end piece 102, first end brush (contour/blending brush) 103, second end piece 104, second end brush (Kabuki brush) 105, transparent rotating panel 106, brush storage compartment 107, and example brush 108.

As may be understood by those of skill in the art, in addition to a cylindrical set, makeup brush kit 100 may comprise a cube, a sphere, or any other shape container known in the art. In some embodiments, makeup brush kit 100 may have one or more lids or hinged openings (not shown). In some embodiments, makeup brush kit 100 may comprise more than one cylinder, or two or more fused or joined cylinders.

Additionally, makeup brush kit 100, may in some embodiments be wider, thinner, longer, shorter, or otherwise of any different shape known in the art. For example, while the makeup brush kit 100 generally disclosed in FIG. 1 may be sized appropriately for a clutch or small purse a larger and/or longer embodiment of makeup brush kit 100 may be provided for larger purses, satchels, or backpacks.

Central cylinder 101 is contemplated to generally have one or more brush storage compartment 107 areas within central cylinder 101. In some embodiments, central cylinder 101 may have one more extra brush storage compartments 107 than required to hold the contemplated brushes. For example, in a ten-brush (five shaft) embodiment, central cylinder 101 may provide for five brush storage compartments 107. This may be to provide for an extra storage area, or to provide for a brush storage compartments 107 that could line up with the dispensing area of transparent rotating panel 106 when the present invention is not in use, thereby saving the brushes from falling out of the dispensing area of transparent rotating panel 106. In some embodiments, central cylinder 101 may provide for one or more closable storage compartments disposed on central cylinder 101. These closable storage compartments may be magnetically closeable, snap-closable, hook and look closeable, or any other element known in the art to provide closeable storage for small items such as mini eyeliners, lipliners, tweezers or small jewelry.

As discussed above, in some embodiments central cylinder 101 may be of a different shape than a cylinder. Such embodiments could include a cube, a prolate spheroid, or any other shape. In such embodiments, transparent rotating panel 106 and brush storage compartment 107, in addition to other elements, may be configured to rotate and operate accordingly.

Remaining with FIG. 1, in some embodiments, first end piece 102 and second end piece 104 may be detachable from, permanently affixed to, or of one piece with central cylinder 101. In some embodiments, first end piece 102 and/or second end piece 104 may extend further from central cylinder 101 than shown in FIG. 1. In some embodiments, the perimeters of first end piece 102 and/or second end piece 104 may not extend beyond the plane of the outside edge of central cylinder 101. While shown as having a disc-like inner portion (relative to central cylinder 101), first end piece 102 and/or second end piece 104 may have a differently shaped inner or base portion than depicted in FIG. 1, such as for non-limiting example, having one or more angled edges.

Relatedly, first end brush 103 and second end brush 105 are generally depicted in FIG. 1 as kabuki and contour/blending-style brushes, but any type of brush is also contemplated as first end brush 103 and/or second end brush 105, including but not limited to a concealer brush, flat liner brush, lip brush, eyeliner brush, smudge brush, small contour/shadow brush, eyeshadow brush, blending brush, angled liner brush, or a mascara brush. Additionally, in some embodiments first end brush 103 and/or second end brush 105 may be larger or smaller, wider or thinner than generally disclosed in FIG. 1.

As may be supposed by those of skill in the art, transparent rotating panel 106 may be comprised of any entirely or partially translucent or transparent material, such as but not limited to glass or plastic. Additionally, in some embodiments (not shown), transparent rotating panel 106 may comprise any type of material, such as metal, wood, or carbon fiber, that surrounds a viewing panel comprised of glass or plastic. In some embodiments, the viewing area may be a cutout in one or more portions of transparent rotating panel 106 (also not shown).

As well, the various panels or contoured areas of transparent rotating panel 106 may vary based on embodiments. As generally shown in FIG. 1, in some embodiments, transparent rotating panel 106 may comprise arcuate portions that are concave towards central cylinder 101. Any exterior or interior configuration is contemplated for transparent rotating panel 106, such as but not limited to hard edges between panels or sections of transparent rotating panel 106, a smooth outside but an angled inside of transparent rotating panel 106, smoothly arcuate interior and exterior portions (as generally disclosed in FIG. 1), or any other combination of edges or design elements.

Relatedly, brush storage compartment 107 may be of any configuration known in the art. In some embodiments, brush storage compartment 107 may be an elongated and roughly concave arcuate area configured to receive a long brush 108, as shown in FIG. 1. However, in some embodiments, storage compartment 107 may be straight, or may have an inconsistent surface, such as having raised elements or cutouts. As it is contemplated that the area behind or around storage compartment 107 may be magnetized, in some embodiments it is not necessary that storage compartment 107 be arcuate or otherwise configured to accommodate the shape of any brush 108. In some embodiments, storage compartment 107 may be configured to receive and retain more than one brush 108.

Figure 2:
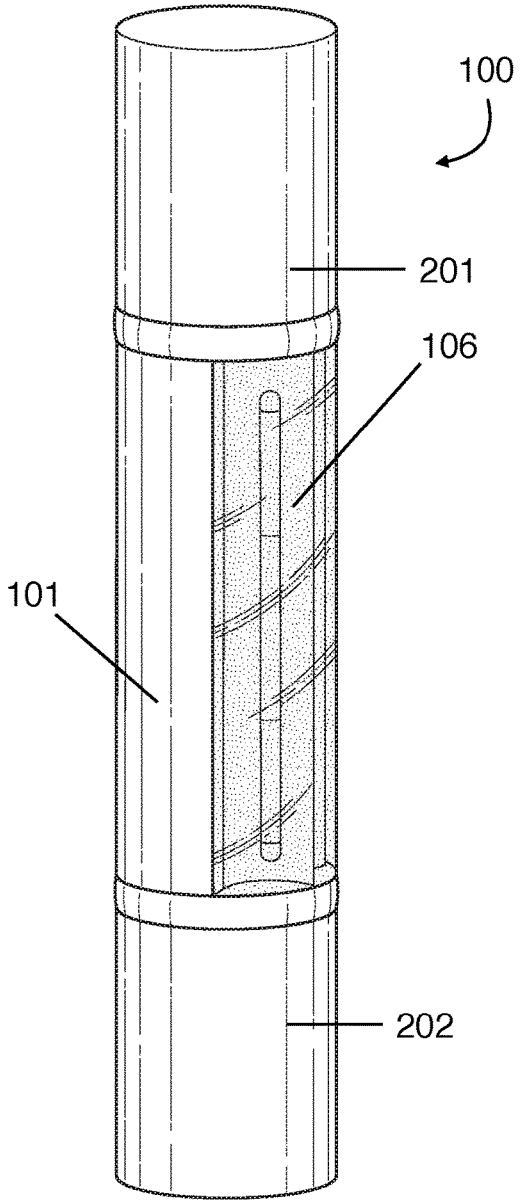
FIG. 2 shows a front perspective view of a makeup brush kit in accordance with an embodiment of the invention.

With respect to FIG. 2, a front perspective view of a makeup brush kit in a closed position in accordance with an embodiment of the invention is shown. In the embodiment depicted, a viewer may perceive first end cap 201 and second end cap 202, as well as makeup brush kit 100, central cylinder 101, transparent rotating panel 106, and brush storage compartment 107.

As may be contemplated by those of skill in the art, first end cap 201 and second end cap 202 may be of any shape known in the art, such as conical, pyramidal, spherical, or any other shape. Additionally, depending on the brush inside first end cap 201 and/or second end cap 202, the sizes of first end cap 201 and second end cap 202 may be larger or smaller, as necessary. Moreover, design elements may be provided on or in first end cap 201 and second end cap 202, such as but not limited to ornamentation, cutouts, illumination elements, and so forth. These and other embellishments are also contemplated to be provided, in some embodiments, on central cylinder 101, transparent rotating panel 106, and brush storage compartment 107, as well as on any element of makeup brush kit 100.

Figure 3:
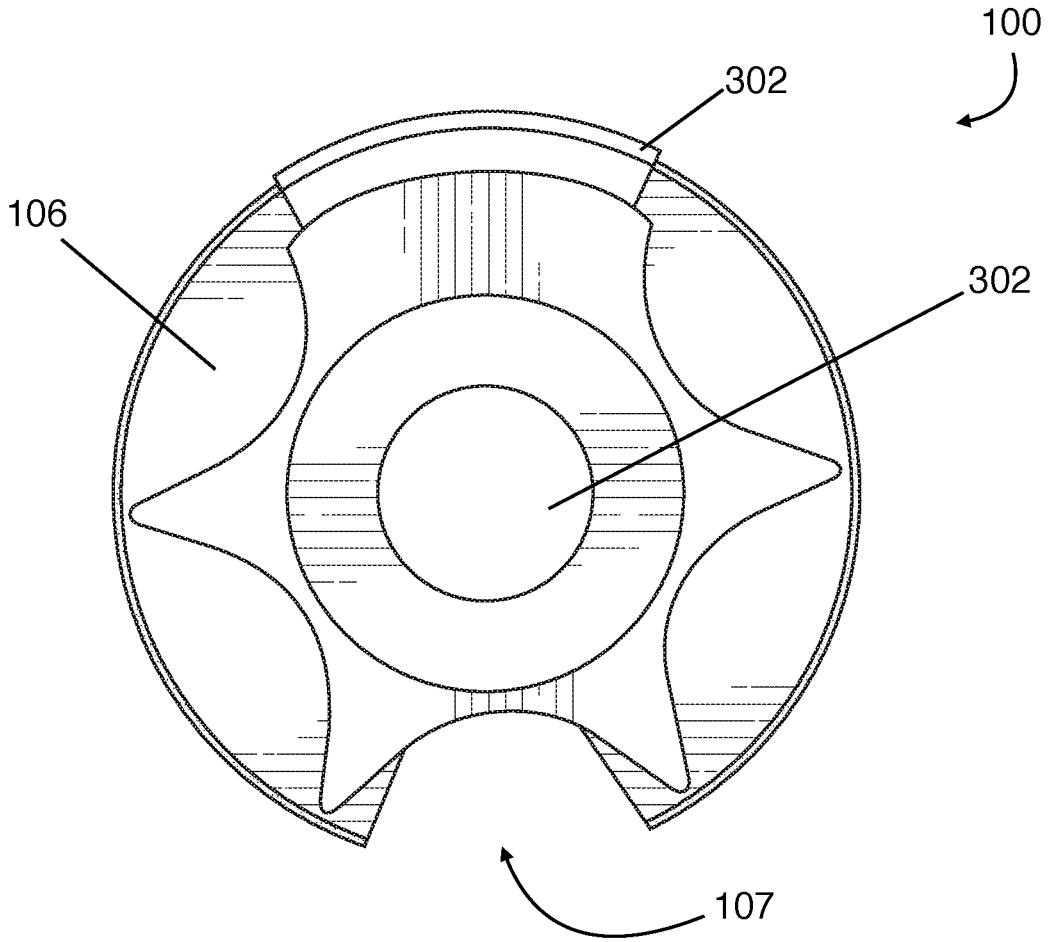
FIG. 3 shows a top plan view of a makeup brush kit in accordance with an embodiment of the invention.

With respect to FIG. 3, a top perspective view of a makeup brush kit in accordance with an embodiment of the invention is shown. In the embodiment depicted, a viewer may perceive central magnetized element 301 and rotating panel activation button 302, as well as central cylinder 101, transparent rotating panel 106, and brush storage compartment 107.

In FIG. 3, a user may see more clarity with respect to one or more notches in transparent rotating panel 106 that enables access to brush storage compartment 107. In some embodiments, more than one notch may be provided in transparent rotating panel 106.

In some embodiments, central magnetized element 301 may be contained within center cylinder 101. It is contemplated that one or more magnetic elements may be contained within central magnetized element 301, whether at the top of central magnetized element 301, in the middle of central magnetized element 301, at the lower portion of central magnetized element 301, or a combination of any positioning. In other embodiments, central magnetized element 301 may not be magnetized, but may instead provide for one or more other removable attachment elements configured to retain shaft 211 within brush storage compartment 107, such as but not limited to hook and loop fasteners, snap clasps, a hook and latch element, or any other removable attachment element known in the art.

It is contemplated that rotating panel activation button 302 may provide spring-loaded, battery-operated, mechanized, or other type of movement element that causes transparent rotating panel 106 to rotate around center cylinder 101, central magnetized element 301, brush storage compartment 107, or any other element of the present invention. It is contemplated that, in some embodiments, a user may press on rotating panel activation button 302, which may activate one or more of the above-described movement or rotation elements to rotate transparent rotating panel 106 the length of one brush storage compartment 107 in a particular direction.

Figure 4:
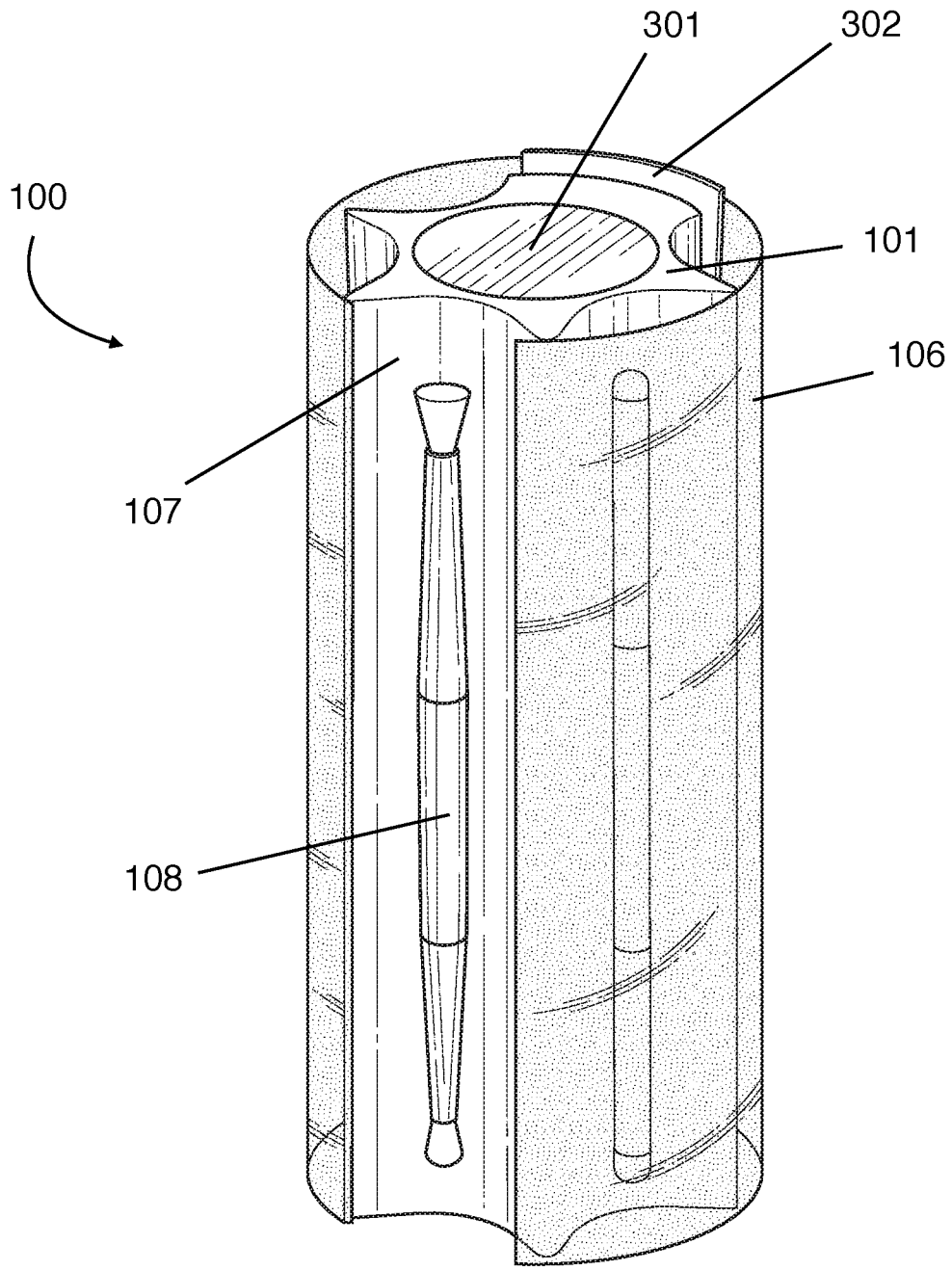
FIG. 4 shows a perspective view of a makeup brush kit in accordance with an embodiment of the invention.

With respect to FIG. 4, a perspective view of a makeup brush kit in accordance with an embodiment of the invention is shown. In the embodiment depicted, a viewer may perceive makeup brush kit 100, central cylinder 101, transparent rotating panel 106, brush storage compartment 107, example brush 108, central magnetized element 301, and rotating panel activation button 302.

Figure 5:
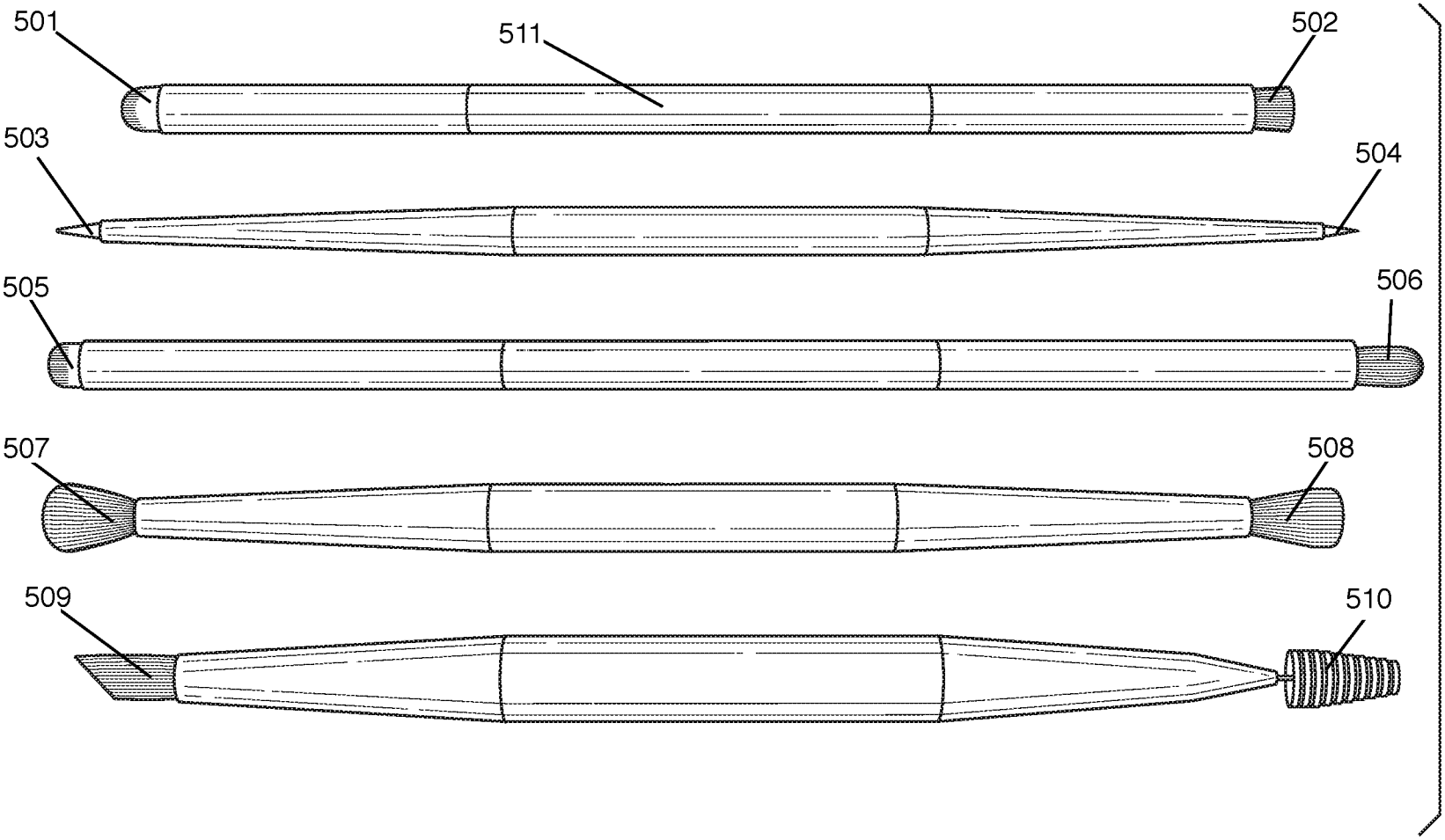
FIG. 5 shows a top plan view of a makeup brush kit in a closed position in accordance with an embodiment of the invention.

With respect to FIG. 5, a top plan perspective view of a makeup brush kit in accordance with an embodiment of the invention is shown. In the embodiment depicted, a viewer may perceive concealer brush 501, flat liner brush 502, lip brush 503, eyeliner brush 504, smudge brush 505, small contour/shadow brush 506, eyeshadow brush 507, eyeshadow blending brush 508, angled liner brush 509, mascara brush 510, and shaft 511.

One of skill in the art may appreciate that other types of brushes, brush tips, and center portions exist within the well-developed makeup brush arts. Therefore, it is contemplated that the brushes shown in FIG. 5 are merely for illustration purposes and serve to illustrate example embodiments only. For example, in some embodiments, one or more large brushes may be provided as a brush of a set such as the one generally depicted in FIG. 5.

In some embodiments, it is contemplated that shaft 511 may be magnetized. In such embodiments, a corresponding magnetic element may be provided in one or more other elements of the present invention that enables shaft 511, and any brush tip associated with shaft 511, to adhere magnetically to brush storage compartment 107 or another element of the present invention.

Conclusions, Ramifications, and Scope

Although the present invention has been described with a degree of particularity, it is understood that the present disclosure has been made by way of example and that other versions are possible. As various changes could be made in the above description without departing from the scope of the invention, it is intended that all matter contained in the above description or shown in the accompanying drawings shall be illustrative and not used in a limiting sense. The spirit and scope of the appended claims should not be limited to the description of the preferred versions contained in this disclosure.

All features disclosed in the specification, including the claims, abstracts, and drawings, and all the steps in any method or process disclosed, may be combined in any combination, except combinations where at least some of such features and/or steps are mutually exclusive. Each feature disclosed in the specification, including the claims, abstract, and drawings, can be replaced by alternative features serving the same, equivalent or similar purpose, unless expressly stated otherwise. Thus, unless expressly stated otherwise, each feature disclosed is one example only of a generic series of equivalent or similar features.

Any element in a claim that does not explicitly state "means" for performing a specified function or "step" for performing a specified function should not be interpreted as a "means" or "step" clause as specified in 35 U.S.C. § 112.

While the makeup brush kit generally described herein has been disclosed in connection with a number of embodiments shown and described in detail, various modifications should be readily apparent to those of skill in the art.

What is claimed is:

1. A makeup brush kit, comprising:

at least one cylindrical center member, comprising:

a) a cylinder first end, a cylinder second end, and a cylinder body;

b) at least two brush storage compartment depressions disposed lengthwise on the cylinder body, wherein each brush storage compartment depression has a width and a length;

c) at least one central magnetic element disposed within the center of the cylinder body;

d) at least one arcuate transparent rotating panel disposed at least partially around the cylinder body, wherein the at least one arcuate transparent rotating panel is configured to at least partially cover at least one brush storage compartment depression, and wherein the at least one arcuate transparent rotating panel is configured to at least partially expose at least one brush storage compartment depression;

e) at least one panel activation button disposed on the cylinder body, wherein the at least one panel activation button is configured to cause the at least one arcuate transparent rotating panel to rotate around the cylinder body in an amount equal to the width of at least one brush storage compartment depression;

at least one end piece comprising:

a) an end piece first side and an end piece second side, wherein at least one end piece first side is configured to removably mate with at least one cylinder first end;

b) at least one end piece brush disposed on the end piece second side;

at least one end cap configured to removably fit over the at least one end piece; and at least one brush comprising:

a) at least one brush tip;

b) a shaft connected to the at least one brush tip; and d) at least one magnetic element disposed within the shaft, wherein the at least one magnetic element is configured to magnetically mate with the at least one central magnetic element.

2. The kit of claim 1, wherein the at least one end piece is at least two end pieces.

3. The kit of claim 2, wherein the at least one end piece brushes are kabuki or contour/blending brushes.

4. The kit of claim 2, wherein the at least one brush tip is at least two brush tips.

5. The kit of claim 1, wherein at least one brush tip is a concealer brush.

6. The kit of claim 5, wherein at least one brush tip is a flat liner brush.

7. The kit of claim 5, wherein at least one brush tip is a lip brush.

8. The kit of claim 5, wherein at least one brush tip is an eyeliner brush.

9. The kit of claim 5, wherein at least one brush tip is a smudge brush.

10. The kit of claim 5, wherein at least one brush tip is a small contour/shadow brush.

11. The kit of claim 5, wherein at least one brush tip is an eyeshadow brush.

12. The kit of claim 5, wherein at least one brush tip is an eyeshadow blending brush.

13. The kit of claim 5, wherein at least one brush tip is an angled liner brush.

14. The kit of claim 5, wherein at least one brush tip is a mascara brush.

15. The kit of claim 1, wherein the at least one cylindrical center member further comprises at least one closeable storage compartment disposed on the at least one cylindrical center member.

* * * * *